US011346299B2

(12) United States Patent
Schmitt

(10) Patent No.: US 11,346,299 B2
(45) Date of Patent: May 31, 2022

(54) METHOD AND DEVICE FOR OPERATING AN INTERNAL COMBUSTION ENGINE HAVING A COMMON-RAIL INJECTION SYSTEM

(71) Applicant: Robert Bosch GmbH, Stuttgart (DE)

(72) Inventor: Joerg Schmitt, Ludwigsburg (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 17/264,091

(22) PCT Filed: Jul. 3, 2019

(86) PCT No.: PCT/EP2019/067846
§ 371 (c)(1),
(2) Date: Jan. 28, 2021

(87) PCT Pub. No.: WO2020/030351
PCT Pub. Date: Feb. 13, 2020

(65) Prior Publication Data

US 2021/0372342 A1 Dec. 2, 2021

(30) Foreign Application Priority Data

Aug. 6, 2018 (DE) ..... 102018213114.7

(51) Int. Cl.
*F02D 41/38* (2006.01)
*F02D 41/14* (2006.01)
*F02D 41/28* (2006.01)

(52) U.S. Cl.
CPC ..... *F02D 41/3809* (2013.01); *F02D 41/1405* (2013.01); *F02D 41/28* (2013.01);
(Continued)

(58) Field of Classification Search
CPC .. F02D 41/3809; F02D 41/1405; F02D 41/28; F02D 2041/1433; F02D 2041/288; F02D 2200/0602; F02D 2200/0614
See application file for complete search history.

(56) References Cited

U.S. PATENT DOCUMENTS 6,088,647 A * 7/2000 Hemberger ..... F02D 41/221 701/104
9,606,017 B2 * 3/2017 Adler ..... G01L 27/00
2017/0234251 A1 * 8/2017 Commenda ..... G01M 15/00 701/33.1

FOREIGN PATENT DOCUMENTS

DE 102004031006 A1 4/2005
DE 102005006361 A1 8/2006
(Continued)

OTHER PUBLICATIONS

International Search Report for PCT/EP2019/067846, dated Oct. 8, 2019.

*Primary Examiner* — Joseph J Dallo
(74) *Attorney, Agent, or Firm* — Norton Rose Fulbright US LLP; Gerard Messina

(57) ABSTRACT

A method for operating an internal combustion engine having a common-rail injection system as a function of a quantity of fuel injected. The method includes determining an information item about a relative-pressure characteristic from a characteristic of an absolute rail pressure in a high-pressure reservoir of the common-rail injection system; determining the quantity of fuel injected as a function of the information item about the relative-pressure characteristic, and with the aid of a trained functional model, in particular, a nonparametric functional model or a neural network; operating the internal combustion engine as a function of the quantity of fuel injected.

15 Claims, 2 Drawing Sheets

(52) U.S. Cl.
CPC ..... *F02D 2041/1433* (2013.01); *F02D 2041/288* (2013.01); *F02D 2200/0602* (2013.01); *F02D 2200/0614* (2013.01)

(56) References Cited

FOREIGN PATENT DOCUMENTS

| | | | | | |
|---|---|---|---|---|---|
| DE | 102005058445 | B3 | | 4/2007 | |
| DE | 102014208379 | A1 | | 11/2015 | |
| DE | 102014215618 | A1 | | 2/2016 | |
| DE | 102016208980 | A1 | | 11/2017 | |
| KR | 20000049232 | A | * | 7/2000 | ..... G05B 17/02 |

* cited by examiner

METHOD AND DEVICE FOR OPERATING AN INTERNAL COMBUSTION ENGINE HAVING A COMMON-RAIL INJECTION SYSTEM

FIELD

The present invention relates to methods for operating an internal combustion engine having a common-rail injection system, in particular, based on a quantity of fuel to be ascertained. In addition, the present invention relates to methods for modeling the quantity of fuel injected in an internal combustion engine having a common-rail injection system.

BACKGROUND INFORMATION

In internal combustion engines having a common-rail injection system, fuel from a high-pressure reservoir is injected through injection valves into the cylinders, directly into the combustion chambers of the cylinders.

At present, the fuel quantity injected is determined based on the rail-pressure characteristic in the high-pressure reservoir, using valve lifts and opening times of the injection valves. These parameters, and also further parameters, in particular, component parameters, are encumbered by high tolerances. In order to compensate for these tolerances, in particular, over the service life, the quantity injected should be estimated with the aid of the rail-pressure characteristic, although the rail-pressure characteristic is also subjected to some tolerances. Thus, there are manufacturing tolerances in the volume of the common-rail injection system, tolerances in the fuel characteristics that are a function of the type of fuel, and measuring tolerances in the measurement of the fuel temperature and the rail pressure. Therefore, quantity estimation methods based on rail pressure have high tolerances irrespective of the manner of determining the quantity of fuel injected. Consequently, the quantity of fuel injected may not easily be determined by a physical model in a reliable manner.

For example, German Patent Application No. DE 10 2005 006 361 A1 describes a method for operating an internal combustion engine, where the fuel is fed at least intermittently into a fuel manifold, to which at least one injector is connected, and where a pressure difference, which occurs in the fuel manifold during at least one injection, is measured. To measure the pressure difference, the fuel manifold is assumed to be an essentially closed system, and the pressure difference is detected in a time-based manner.

German Patent Application No. DE 10 2014 215 618 A1 relates to a method for determining a quantity of fuel injected, which is extracted from a high-pressure reservoir and injected into one or more combustion chambers of an internal combustion engine. The characteristic of the fuel pressure in the high-pressure reservoir is measured, and a characteristic of the fuel pressure transformed by frequency is ascertained. The quantity injected is ascertained from a component belonging to the ignition frequency of the internal combustion engine, in the characteristic of the fuel pressure transformed by frequency.

German Patent Application No. DE 10 2004 031 006 A1 describes a method for determining at least one quantity of fuel injected in an internal combustion engine having a common-rail injection system, with the aid of a rail-pressure sensor and an engine control unit having an artificial neural network. The neural network is used, in order to allow a quantity injected to be determined from rail-pressure data in real time. To that end, absolute values of the rail-pressure characteristic are ascertained and supplied to the neural network as an input variable vector.

SUMMARY

The present invention provides a method for operating an internal combustion engine having a common-rail injection system, as well as a device and an engine system.

Example embodiments and refinements of the present invention are described herein.

According to a first aspect of the present invention, a method for operating an internal combustion engine having a common-rail injection system, as a function of a quantity of fuel injected, is provided. In accordance with an example embodiment of the present invention, the method include the following steps:

- determining an information item about a relative-pressure characteristic from a characteristic of an absolute rail pressure in a high-pressure reservoir of the common-rail injection system;
- determining the quantity of fuel injected as a function of the information item about the relative-pressure characteristic, and with the aid of a trained functional model, in particular, a nonparametric functional model or a neural network; and
- operating the internal combustion engine as a function of the quantity of fuel injected.

The above example method for operating the internal combustion engine is based on a determination of a quantity of fuel injected as a function of a characteristic of a fuel pressure in a high-pressure reservoir of the common-rail injection system (rail-pressure characteristic). This characteristic of the fuel pressure is subjected to several tolerances. The modeling is accomplished, using a trainable model, in particular, with the aid of a nonparametric model, such as a Gaussian process model, and/or a neural network. A main feature of the above method is to configure the model in such a manner, that it is as independent as possible of the tolerances of the parameters encumbered by tolerances. The dependence of the pressure drop Δp in the high-pressure reservoir that results due to the injection of a quantity of fuel is:

$$\Delta p = \frac{K(p, T)}{V}\Delta V$$

for the injected volume of fuel ΔV and $$\Delta p = \frac{c^2(p, T)}{V}\Delta m$$

for the injected mass of fuel Δm.

Consequently, the quantity of fuel injected may be specified as a volume-based quantity of fuel injected ΔV or as a mass-based quantity of fuel injected Δm.

It is apparent that the factor $$\frac{K(p, T)}{V} \text{ and/or } \frac{c^2(p, T)}{V}$$

includes quantities encumbered by tolerances, such as an absolute rail pressure p in the high-pressure reservoir, a fuel temperature T in the high-pressure reservoir, and a storage volume V of the high-pressure reservoir, as well as a compressibility K or $c^2$.

During training of a nonparametric model, the variables encumbered by tolerances must be simulated in their possible tolerance ranges, in order to obtain appropriate training data for the model to be modeled. This is cumbersome, and therefore, in accordance with an example embodiment of the present invention, it is provided that the quantity of fuel injected be estimated based on only a characteristic of the relative pressure in the high-pressure reservoir, and that no other parameters relevant to the structure of the high-pressure reservoir and the fuel stored in it be considered in the training method. In particular, consideration of the variables of the absolute pressure, the temperature, and the volume of the high-pressure reservoir, as well as the compressibility of the fuel as a function of the type of fuel used, should be explicitly dispensed with.

Training of the nonparametric model based on only the relative-pressure characteristic of the rail pressure may be carried out in a highly simple manner, and consequently, in a very short time on the test stand, it is possible to adapt the model to the individual combustion engine. The consideration of the relative-pressure characteristic independent of the above-mentioned parameters allows the influences of the individual, tolerance-encumbered parameters to be learned so as to be subsumed in the relative-pressure characteristic, which means that it is possible to estimate the quantity of fuel injected by suitably formulating an input variable vector, which describes the characteristic of the relative pressure in the high-pressure reservoir.

In addition, the relative-pressure characteristic may be determined as a function of a reference rail pressure, which is derived as a mean or initial value of a rail-pressure characteristic in a current or preceding operating cycle of the internal combustion engine.

According to one specific embodiment of the present invention, the quantity of injected fuel may be determined as a function of a pressure difference between a maximum rail pressure and a minimum rail pressure.

Furthermore, the information item about the relative-pressure characteristic may be specified as a relative-pressure characteristic information item, which represents at least a part of an input variable vector for the trained functional model.

In particular, the relative-pressure characteristic information item may include one or more of the following information items:

- values of the relative-pressure characteristic that are temporally equidistant or equidistant with regard to a crankshaft angle in the current operating cycle;
- a gradient of a pressure drop over time of a maximum pressure or a minimum pressure of the relative-pressure characteristic; and
- an FFT coefficient (that is, magnitude of a harmonic), in particular, a first FFT coefficient, from a Fourier transform of the rail-pressure characteristic.

Furthermore, the quantity injected may additionally be determined, using an engine speed information item, which corresponds, in particular, to an average speed of the internal combustion engine during the current operating cycle, or using a load information item.

BRIEF DESCRIPTION OF THE DRAWINGS

Specific embodiments of the present invention are explained in greater detail below, on the basis of the figures.

DETAILED DESCRIPTION OF EXAMPLE EMBODIMENTS

Figure 1:
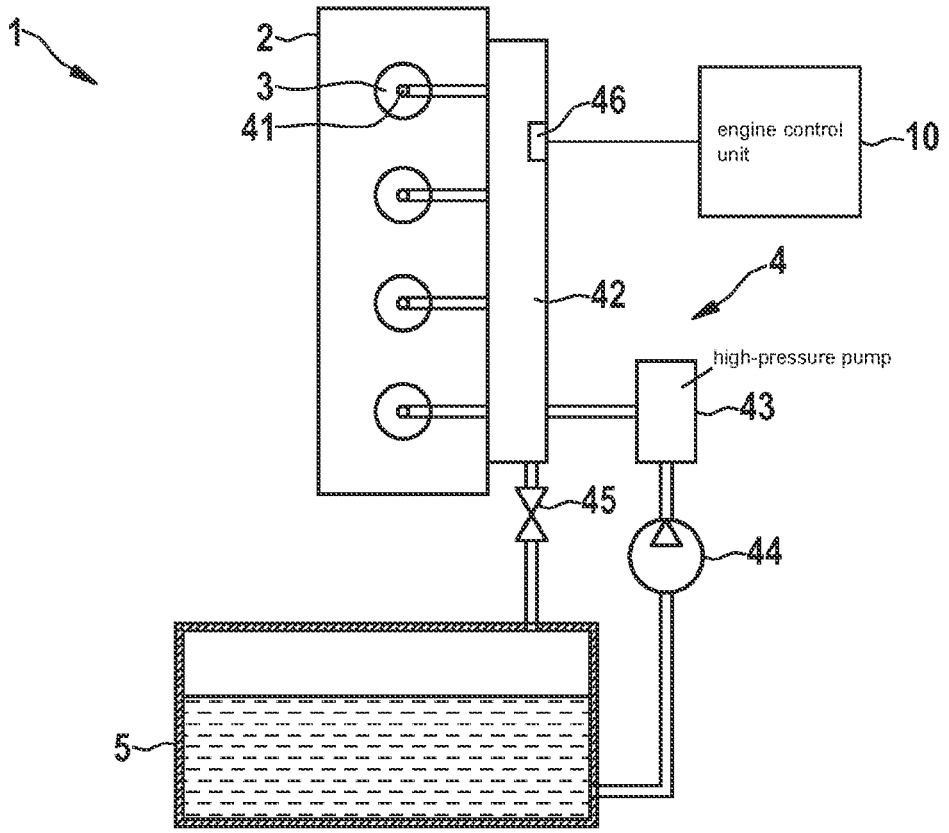
FIG. 1 shows a schematic representation of an engine system including an internal combustion engine and a common-rail injection system.

FIG. 1 shows a schematic representation of an engine system 1, including an internal combustion engine 2 having a plurality of cylinders 3, and a common-rail injection system 4. Common-rail injection system 4 has a normal design and includes one injection valve 41 for each of the cylinders 3; fuel from a high-pressure reservoir 42 being able to be injected into cylinders 3 via the injection valves. High-pressure reservoir 42 is connected to a high-pressure pump 43, in order to keep fuel from a fuel tank 5 pre-supplied by a feed pump 44 at a high pressure in high-pressure reservoir 42.

In addition, high-pressure reservoir 42 is connected to an adjustable pressure-regulating valve 45, in order to adjust a rail pressure in high-pressure reservoir 42, that is, the pressure of the fuel in high-pressure reservoir 42, to a predefined setpoint rail pressure. To control the rail pressure, fuel may be supplied to high-pressure reservoir 42 by high-pressure pump 43 and fed back to fuel tank 5 via pressure-regulating valve 45.

The control of engine system 1 is carried out by an engine control unit 10, which, in order to control the internal combustion engine, acquires sensor signals and outputs appropriate actuating signals to actuators of engine system 1. Thus, engine control unit 10 measures the rail pressure, using a rail-pressure sensor 46 in high-pressure reservoir 42.

In addition, engine control unit 10 controls actuators of engine system 1 on the basis of actuating variables and on the basis of a predefined setpoint engine torque, which may be ascertained, for example, from an inputted torque desired by the driver.

Apart from other functions, engine control unit 10 includes a function for ascertaining a quantity of fuel injected. The quantity of fuel injected is needed for operating engine system 1, since a set engine torque may be derived and/or ascertained from it. In addition, this may be used for checking the plausibility of, and adapting, the function of the injection valves, in order to be able to adjust the actual quantity of fuel injected more accurately.

The quantity of fuel injected may be ascertained by a trained, parameter-free functional model, from a pressure characteristic of the rail pressure in high-pressure reservoir 42. The trained functional model may be, for example, a nonparametric functional model, such as a Gaussian process model or a neural network. In general, the following equation is yielded for the quantity of fuel injected:

$$\Delta p = \frac{K(p, T)}{V} \Delta V$$

as a volume-based quantity of fuel injected ΔV (volume of fuel injected) and $$\Delta p = \frac{c^2(p, T)}{V}\Delta m$$

as a mass-based quantity of fuel injected Δm (mass of fuel injected).

In this context, p corresponds to the absolute rail pressure in high-pressure reservoir 42, Δp corresponds to a drop in the rail pressure (pressure difference) caused by the injection, T corresponds to a fuel temperature in high-pressure reservoir 42, V corresponds to a storage volume of high-pressure reservoir 42, and K and/or $c^2$ corresponds to a compressibility of the fuel as a function of rail pressure p and fuel temperature T. Function K or $c^2$ reflects the compressibility of the fuel, which may be a function of the type of fuel.

The determination of the type of fuel, the determination of absolute rail pressure p, the determination of fuel temperature T in high-pressure reservoir 42, as well as the determination of actual volume V of high-pressure reservoir 42 are encumbered by tolerances; in particular, the determination of absolute rail pressure p being highly error-prone. The use of a physical model, which reflects the above relationship, is not considered, since errors in the different parameters may increase and, thus, result in unusable model values for injected fuel quantities to be determined.

Therefore, in accordance with an example embodiment of the present invention, it is provided that with the aid of a trainable functional model, the entire factor $$X = \frac{K(p, T)}{V} \text{ and/or } \frac{c^2(P, T)}{V}$$

between the pressure difference and the fuel quantity be determined according to the above-mentioned formula. A functional model may indeed be trained for the factor X, which is a function of the parameters type of fuel, absolute rail pressure p, fuel temperature T in high-pressure reservoir 42, and the volume of high-pressure reservoir 42, but for taking tolerances into account, not all of the above-mentioned parameters may be varied on a test stand, in order to cover all possible system states. In particular, the deliberate variation of storage volume V of high-pressure reservoir 42 is difficult to accomplish, since this would entail the removal and installation of different high-pressure reservoirs. In addition, varying the type of fuel over all fuels found in practical operation is highly burdensome.

It has been determined that pressure characteristic p in high-pressure reservoir 42 reflects the influences of the parameters mentioned above. This occurs independently of the absolute rail pressure in high-pressure reservoir 42. Consequently, a trainable functional model may be trained with the aid of pressure variation, that is, a pressure-change characteristic based on an absolute reference pressure; the absolute reference pressure value being able to correspond to an average pressure value of a preceding operating cycle or to a cycle entrance pressure (as the first rail-pressure value of the current operating cycle). The operating cycle relates to four-stroke operation of a cylinder and corresponds to two revolutions of the crankshaft and/or a period of time needed for them.

While the measurement of absolute rail pressure p in high-pressure reservoir 42 may be highly error-prone, measurements of the pressure fluctuations of rail pressure p, that is, of the relative-pressure characteristic, may be taken relatively accurately and error-free. In addition, such a pressure-change characteristic of the rail pressure in high-pressure reservoir 42 reflects the physical conditions of common-rail injection system 4 effectively and also exhibits a decreased error. In particular, the trained functional model is provided in such a manner, that it only processes information items about the relative pressure characteristic of the rail pressure in high-pressure reservoir 42, but not information items regarding the type of fuel, absolute rail pressure p, fuel temperature T and volume V of high-pressure reservoir 42. From the outset, this prevents error-prone variables from being included in the learning operation for the trainable functional model.

Figure 2:
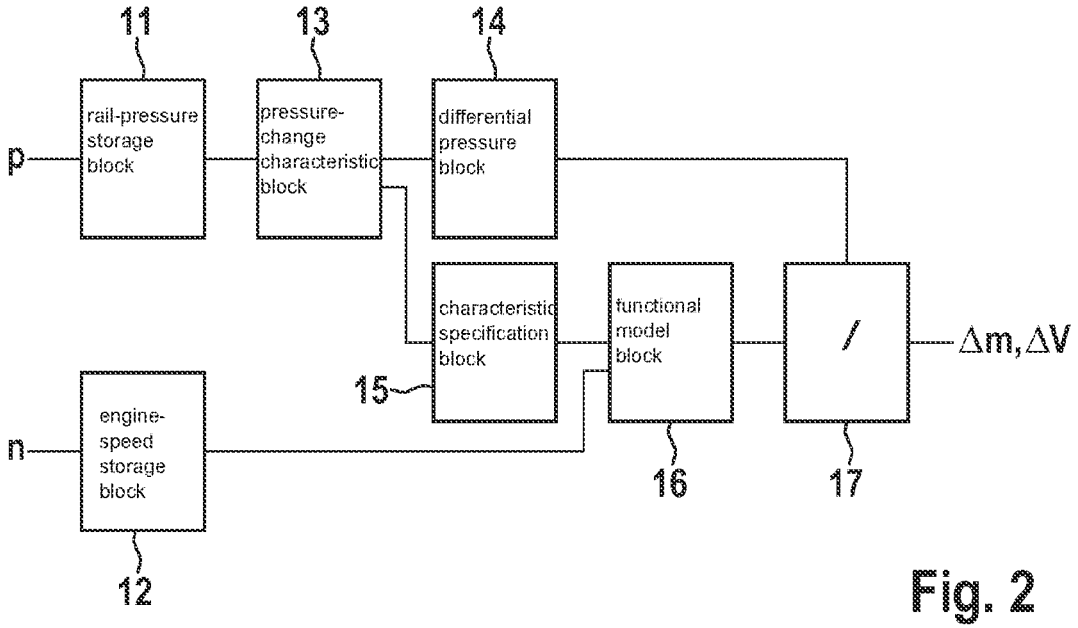
FIG. 2 shows a flow chart for illustrating the function for ascertaining a quantity of fuel injected, based on a characteristic of the rail pressure in the high-pressure reservoir of the common-rail injection system.

A flow chart capable of being implemented in engine control unit 10 in accordance with a specific embodiment is represented in FIG. 2.

In a rail-pressure storage block 11, a characteristic curve of rail pressure p is recorded at least for the current operating cycle, using rail-pressure sensor 46, and stored in a suitable manner. In addition, the engine speed or another load information item of internal combustion engine 2 may be stored in an engine-speed storage block 12.

In a pressure-change characteristic block 13, the stored characteristic of absolute rail pressure p is processed, in order to obtain a relative-pressure characteristic of rail pressure p. This may take place on the basis of the absolute reference rail pressure, which corresponds to an average value of the rail pressure during one or more operating cycles, a value of absolute rail pressure p at the beginning of the current operating cycle, or a maximum value of rail pressure p during the operating cycle.

Figure 3:
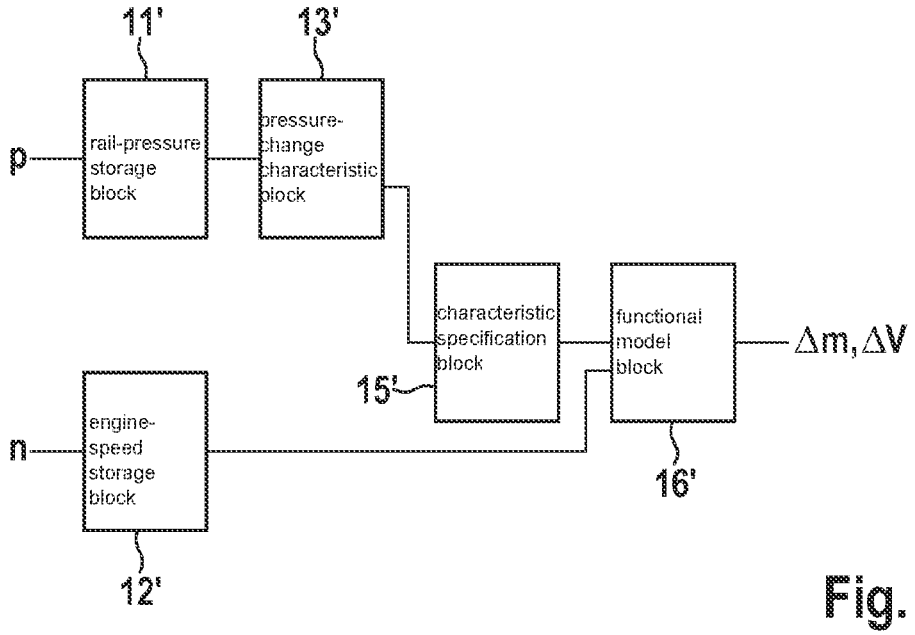
FIG. 3 shows a flow chart for illustrating the function for ascertaining a quantity of fuel injected, based on a characteristic of the rail pressure in the high-pressure reservoir of the common-rail injection system, according to a further specific embodiment.
Figure 4:
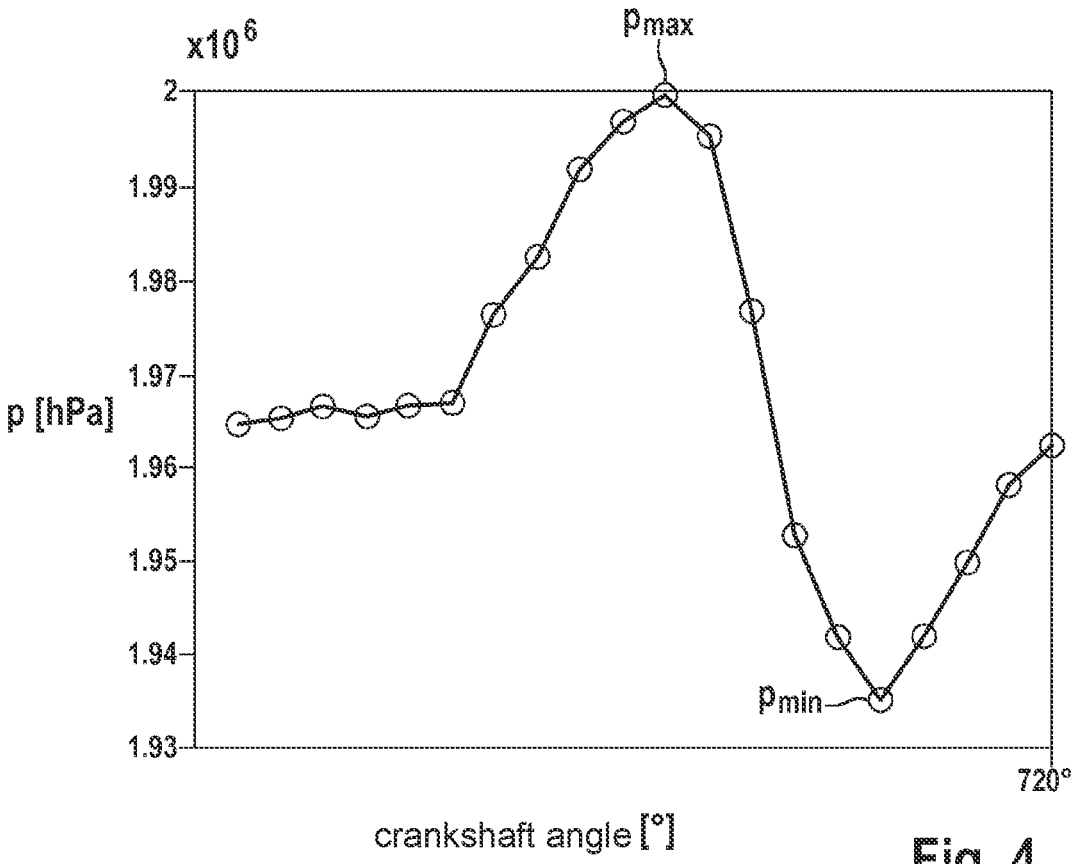
FIG. 4 shows a time characteristic of the rail pressure in the range of 2000 bar.

In a differential pressure block 14, pressure difference Δp between a maximum rail pressure $p_{max}$ and a minimum rail pressure $p_{min}$ within an operating cycle may be ascertained (see FIG. 3).

In addition, the relative-pressure characteristic is processed in a characteristic specification block 15, in order to describe the relative-pressure characteristic in a suitable manner for processing in the functional model. In this context, the relative-pressure characteristic is provided as a relative-pressure characteristic information item. In this context, a suitable compromise should be adopted between the number of supplied input variables and the degree of detail of the description of the relative-pressure characteristic. A relative-pressure characteristic information item is available as a result of characteristic specification block 15.

Together with an engine-speed information item, which corresponds, for example, to an average engine speed of internal combustion engine 2 during the current operating cycle, or to another load information item, the relative-pressure characteristic information item may now be provided as an input variable vector for a functional model block 16. The functional model implemented in functional model block 16 now determines factor X on the basis of the relative-pressure characteristic represented by the input variable vector.

Consequently, in functional model block 16, in which the nonparametric functional model, such as the Gaussian process model or the neural network, is implemented, factor X is derived from the relative-pressure characteristic information item.

Now, in a division block 17, the differential pressure may be divided by the particular factor X, in order to obtain the quantity of fuel injected ΔV, Δm.

The relative pressure characteristic of rail pressure p in high-pressure reservoir 42 may be indicated by the relative-pressure characteristic information item in different ways, which may be used separately or in combination in the form of the relative-pressure characteristic information item of the input variable vector for the trainable functional model:

Points of reference of the relative rail-pressure values (based on the absolute reference pressure value) may be specified; the points of reference being equidistant (temporally or with regard to a crankshaft angle in the current operating cycle); the points of reference covering the entire operating cycle, that is, two crankshaft revolutions.

A gradient of the pressure drop over time of a maximum pressure or a minimum pressure of the relative-pressure characteristic may be used.

The first FFT coefficient and/or one or more additional FFT coefficients from a Fourier transform of the rail-pressure characteristic may be used.

A flow chart capable of being implemented in engine control unit 10 in accordance with a further specific embodiment is represented in FIG. 3.

The components corresponding to the specific embodiment of FIG. 2 are labeled 11', 12', 13', 15' and 16'. In contrast to the specific embodiment of FIG. 2, the pressure difference (in differential pressure block 14) is not calculated separately, but is a part of characteristic specification block 15', in which the pressure difference is ascertained directly or indirectly as part of the relative-pressure characteristic and provided as an input variable for functional model block 16'. In this context, the functional model is defined in such a manner, that the quantity of fuel injected ΔV, Δm is ascertained directly as a function of the relative-pressure characteristic information item.

To train the trainable functional model, a factor X, which results from an actual quantity of fuel injected and a differential pressure between a maximum pressure and a minimum pressure of the relative-pressure characteristic, in particular, as a quotient, is learned on a test stand for different operating points of the internal combustion engine, in particular, at different engine speeds and load torques and in the case of the respective relative-pressure characteristic information item. The actual quantity of fuel injected may be calculated from the engine torque with the aid of conventional models.

What is claimed is:

1. A method for operating an internal combustion engine having a common-rail injection system, the method comprising the following steps:

determining, from detected absolute rail pressures in a high-pressure reservoir of the common-rail injection system, an information item about a relative pressure characteristic corresponding to a change in the detected absolute pressures over time;

determining a quantity of fuel injected irrespective of an actual current pressure in the high-pressure reservoir as a function of (a) the information item about the relative-pressure characteristic and (b) a factor obtained from a trained functional model, the functional model being a nonparametric functional model or a neural network, wherein the factor is a ratio of a compressibility of the fuel to a storage volume of the high-pressure reservoir; and operating the internal combustion engine as a function of the quantity of fuel injected.

2. The method as recited in claim 1, wherein the relative-pressure characteristic is determined as a function of a reference rail pressure, which corresponds to an average value or an initial value or a maximum value of a rail-pressure characteristic in a current cycle or preceding operating cycle of the internal combustion engine.

3. The method as recited in claim 1, wherein the quantity of fuel injected is specified as a volume-based quantity of fuel injected or as a mass-based quantity of fuel injected.

4. The method as recited in claim 1, wherein the quantity of fuel injected is determined as a function of a pressure difference between a maximum rail pressure and a minimum rail pressure.

5. The method as recited in claim 1, wherein the information item about the relative-pressure characteristic is specified as a relative-pressure characteristic information item, which represents part of an input variable vector for the trained functional model.

6. The method as recited in claim 5, wherein the relative-pressure characteristic information item includes values of the relative-pressure characteristic selected based on being temporally equidistant or equidistant from one another with regard to a crankshaft angle in a current operating cycle.

7. The method as recited in claim 6, wherein the quantity injected is additionally determined using: (i) an engine speed information item, which corresponds to an average speed of the internal combustion engine during a current operating cycle, or (ii) a load information item.

8. A device configured to operate an internal combustion engine having a common-rail injection system, wherein the device is configured to:

determine, from detected absolute rail pressures in a high-pressure reservoir of the common-rail injection system, an information item about a relative pressure characteristic corresponding to a change in the detected absolute pressures over time;

determine a quantity of fuel injected irrespective of an actual current pressure in the high-pressure reservoir as a function of (a) the information item about the relative-pressure characteristic and (b) a factor obtained from a trained functional model, the functional model being a nonparametric functional model or a neural network, wherein the factor is a ratio of a compressibility of the fuel to a storage volume of the high-pressure reservoir; and operate the internal combustion engine as a function of the quantity of fuel injected.

9. A drive system, comprising:

an internal combustion engine having a common-rail injection system; and a device configured to operate the internal combustion engine, wherein the device is configured to:

determine, from detected absolute rail pressures in a high-pressure reservoir of the common-rail injection system, an information item about a relative pressure characteristic corresponding to a change in the detected absolute pressures over time;

determine a quantity of fuel injected irrespective of an actual current pressure in the high-pressure reservoir as a function of (a) the information item about the relative-pressure characteristic and (b) a factor obtained from a trained functional model, the functional model being a nonparametric functional model or a neural network, wherein the factor is a ratio of a compressibility of the fuel to a storage volume of the high-pressure reservoir; and operate the internal combustion engine as a function of the quantity of fuel injected.

10. A non-transitory machine-readable storage medium on which is stored a computer program that is executable by a computer and that, when executed by the computer, causes the computer to perform a method, the method comprising the following steps:

determining, from detected absolute rail pressures in a high-pressure reservoir of the common-rail injection system, an information item about a relative pressure characteristic corresponding to a change in the detected absolute pressures over time;

determining a quantity of fuel injected irrespective of an actual current pressure in the high-pressure reservoir as a function of (a) the information item about the relative-pressure characteristic and (b) a factor obtained from a trained functional model, the functional model being a nonparametric functional model or a neural network, wherein the factor is a ratio of a compressibility of the fuel to a storage volume of the high-pressure reservoir; and operating the internal combustion engine as a function of the quantity of fuel injected.

11. The method as recited in claim 1, wherein the factor obtained from the trained functional model varies depending on a current operating point of the internal combustion engine.

12. The method as recited in claim 1, wherein the factor obtained from the trained functional model varies depending on a current speed of the internal combustion engine.

13. The method as recited in claim 1, wherein the factor obtained from the trained functional model varies depending on a current load torque of the internal combustion engine.

14. The method as recited in claim 5, wherein the relative-pressure characteristic information item includes a gradient of a pressure drop over time of a maximum pressure or a minimum pressure of the relative-pressure characteristic.

15. The method as recited in claim 5, wherein the relative-pressure characteristic information item includes a first FFT coefficient, from a Fourier transform of the rail-pressure characteristic.

* * * * *